United States Patent [19]

Hyde

[11] Patent Number: 4,976,608

[45] Date of Patent: Dec. 11, 1990

[54] IGNITOR DEVICE

[76] Inventor: King W. Hyde, 1414 N. Belmont, Odessa, Tex. 79763

[21] Appl. No.: 462,090

[22] Filed: Jan. 8, 1990

[51] Int. Cl.[5] ..... F23D 14/00

[52] U.S. Cl. ..... 431/202; 431/264; 431/285

[58] Field of Search ..... 431/202, 278, 285, 264

[56] References Cited

U.S. PATENT DOCUMENTS

| | | | |
|---|---|---|---|
| 1,593,331 | 7/1926 | Eilar | 431/354 |
| 2,460,016 | 1/1949 | Kuhn | 158/115 |
| 2,537,091 | 1/1951 | Rodman et al. | 158/115 |
| 2,648,376 | 8/1953 | Schrader | 158/115 |
| 2,661,798 | 12/1953 | Clevenger et al. | 158/115 |
| 2,693,937 | 11/1954 | Wyland, Jr. | 255/36 |
| 2,696,875 | 12/1954 | Henwood | 158/115 |
| 2,855,987 | 10/1958 | Schylander | 158/53 |
| 2,869,631 | 1/1959 | Zink | 158/115 |
| 3,315,745 | 7/1964 | Rees, Jr. | 166/59 |
| 3,729,287 | 4/1973 | Strashok | 431/202 |
| 3,914,094 | 10/1975 | Landry | 431/202 |
| 3,932,111 | 1/1976 | Liknes et al. | 431/202 |
| 4,406,615 | 9/1983 | Guerra et al. | 431/278 |
| 4,741,691 | 5/1988 | Messimer | 431/202 |
| 4,826,427 | 5/1989 | Hyde | 431/202 |

OTHER PUBLICATIONS

American Gas Assoc. advertisement, Wall Street Journal, dated Nov. 7, 1989, p. A 24.

*Primary Examiner*—Carroll B. Dority

*Attorney, Agent, or Firm*—Richards, Medlock & Andrews

[57] ABSTRACT

The present invention provides an ignitor device having a burner tube, a nozzle, an expansion tube leading between them, and a means to spark an air/fuel mixture introduced into said burner tube. The ignitor is used to ignite waste gases exiting from an attached flare pipe. A baffle plate is also provided to prevent flame from damaging the ignitor or flare pipe. A bonnet with internal vanes is also provided to protect the combusting waste gas from high winds and to swirl the flame for stability.

25 Claims, 2 Drawing Sheets

IGNITOR DEVICE

TECHNICAL FIELD OF THE INVENTION

This invention relates to an ignitor device. More specifically, it relates to a device designed to burn combustible waste gases with a constant source of flame. The ignitor device incorporates a burner tube in which a feeder stream of fuel gas is ignited by means of a spark plug. This tube then directs the combusting fuel gas flame over a flare pipe through which waste gases are exiting. The spark plug automatically and continuously sparks at designated intervals to assure the constant combustion of the fuel gas.

BACKGROUND OF THE INVENTION

It is customary around the production and refinement of petroleum products to burn or "flare" waste gases. These waste gases can be the natural byproducts of oil production. They can also be produced through the refinement of raw oil into more suitable forms. Waste gases include many low BTU hydrocarbons, hydrogen sulfide ($H_2B$), carbon monoxide and even carbon dioxide. The combustion of these waste gases converts them into a more inert form.

State and federal air quality regulations mandate the ignition of waste gases to prevent their release into the atmosphere. Moreover, this ignition must be maintained during the venting of these gases. Particular care must be exercised to prevent the ignition of the waste gases from blowing out, leaving only uncombusted waste gases exhausting into the atmosphere. An ignitor device provides a source of flame to ignite or reignite waste gases.

Ignitor devices encounter several problems. Namely, high winds can blow out their flame as well as the flame from combusting waste gases. High winds can also cause "flame-lick" in which the flame is blown down the sides of the pipe. The flame licking back down the pipe may actually damage or destroy the ignitor device and flare pipe. The fire problem is particularly pointed out in U.S. Pat. No. 2,661,798 to Clevenger, et al. and in U.S. Pat. No. 2,537,091 to Rodman, et al., both of which describe steps to protect the ignitor from the damage of flame-lick. These steps have often resulted in a loss of reliability.

The ignition of the waste gas may also be extinguished due to the low BTU value of those gases. Their own burning does not provide enough heat to maintain the combustion. Also, the combustion of the waste gas may be affected by the velocity with which waste gas exits the flare pipe. High velocity exhaust may cause the flame to "lift-off" from the top of the flare pipe. The flame will then self-extinguish for lack of additional combustible gas.

Another problem is present with ignitor devices used during the drilling and production of oil and gas wells. In such cases, the gases to be burned come directly from the well and through a stack or flare pipe. Unfortunately, water, mud and heavy petroleum products having low volatility and high viscosity will be emitted through the stack intermittently with the production of gases. These liquids which are either incombustible or not readily combustible will put out the flame if one is already burning. In addition to this, the liquids may flow into the ignitor, filling the ignitor. This clogging will prevent the fuel/air mixture used to produce its flame from flowing into the combustion chamber.

Ignitor devices in the prior art also are deficient in their ability to notify operators that combustion has ceased. State and federal laws often mandate a reliable notification method to signal ignition failure. In response to the problem of ignition failure, various devices have been used to detect when the ignition of waste gases has ceased. A thermocouple can sense the drop in heat, but must cool down before it will reignite the ignitor. Infrared or ultraviolet sensors can also detect the presence of a flame. However, these devices require a great deal of maintenance to insure their reliability.

A need exists for a simple and reliable ignitor device capable of igniting and automatically re-igniting waste gases. Such an ignitor should be able to provide a flame incapable of being blown out by high winds. Such an ignitor should also be designed so that fluids cannot clog it. Additionally, an ignitor is needed which provides a stable environment for the burning of waste gases by inhibiting flame lift-off.

SUMMARY OF THE INVENTION

This invention relates to a novel ignition device that provides a source of flame to ignite waste gases while they are released into the atmosphere from a flare pipe. In one embodiment of the invention, the ignitor is comprised of four primary elements: a burner tube, a nozzle, an expansion tube and a spark plug.

A combustible liquid or fuel gas such as propane is injected through the nozzle and into an expansion tube. The nozzle is adjustably held in-line with the expansion tube within a bracket attached to a suitable mount such as the flare pipe. An adjustment screw holds the nozzle in place within the bracket. The bracket and adjustment screw allow for manipulation of the air/fuel mixture because operators can change nozzles or adjust nozzle position easily.

A windshield extending from the upstream end of the expansion tube protects the spray from winds. This fuel gas then passes through the expansion tube. The expansion tube is typically an open-ended cylindrical tube of varying internal diameter, having an upstream end and a downstream end. If a combustible liquid is used, the expansion tube will transform it to a gas. Air is also drawn into the expansion tube from holes in the windshield and from the open upstream end of the expansion tube. This air mixes with the fuel gas. The air/fuel mixture passes from the expansion tube into the burner tube. The spark plug is mounted through the wall of the burner tube. This spark plug produces a spark at a predetermined interval such as every five seconds continuously by means of a timer device.

The spark ignites the air/fuel mixture which travels through the burner tube and exits through an opening at its downstream end. The ignition spark is repeated at the predetermined interval even if the fuel gas had maintained combustion, thereby assuring the combustion will be maintained in the event of a blow out. The fuel gas flame is directed over the opening of the flare pipe from which waste gases are emitting. Hence, the invention ignites the waste gas. In summary, this ignitor uses a simple jet principle. The expanding fuel gas volume not only discourages entrance of fluid into the ignitor, but forces the flame into the waste gases. The ignitor also makes an audible "jet" noise which notifies on-site personnel by ceasing should ignition fail. This satisfies any audible notification rules found in some state and federal rules.

In a further embodiment of the present invention, a baffle plate is provided. This plate extends radially around both the ignitor and the flare pipe. It is a high melting-point, stainless or carbon steel which deflects any flame which licks-back upon the ignitor or flare pipe due to high wind. The baffle plate also protects against corrosive fluids which can spillover out of the flare pipe.

In yet another embodiment, a bonnet is provided which surrounds the top of the flare pipe. The bonnet is an open-ended cylindrical tube which mounts atop the baffle plate. A gap or air draft space is left between the bottom of the bonnet and the top of the baffle plate. The flare pipe extends longitudinally into the bonnet. The ignitor mounts such that only the downstream end extends through the bonnet's side and over the top of the flare pipe. Hence, the ignitor emits a flame above the flare pipe within the bonnet. The waste gases ignite and are protected from high wind by the bonnet. The gap between the bonnet and the baffle plate provides a path for air to be drawn into and mix with the waste gases to produce a combustible mixture.

In a preferred embodiment, angular vanes located within the bonnet swirl the air introduced to and mixed with the igniting waste gases. This swirling action helps slow and stabilize the flame and minimizes the risk of lift-off. This stability also decreases the amount of smoke produced by igniting waste gases. Angular vanes can also be present in or at the tip of the flare pipe. These vanes swirl and expand the waste gases outward to the bonnet's sides. This, in turn, slows the tip velocity of waste gases and promotes the physical mixing of gases with different specific gravities, promoting a smokeless, stable flame.

BRIEF DESCRIPTION OF THE DRAWINGS

For a more complete understanding of the present invention, and for further details and advantages thereof, reference is now made to the following Detailed Description taken in conjunction with the accompanying drawings, in which.

DETAILED DESCRIPTION

Figure 1:
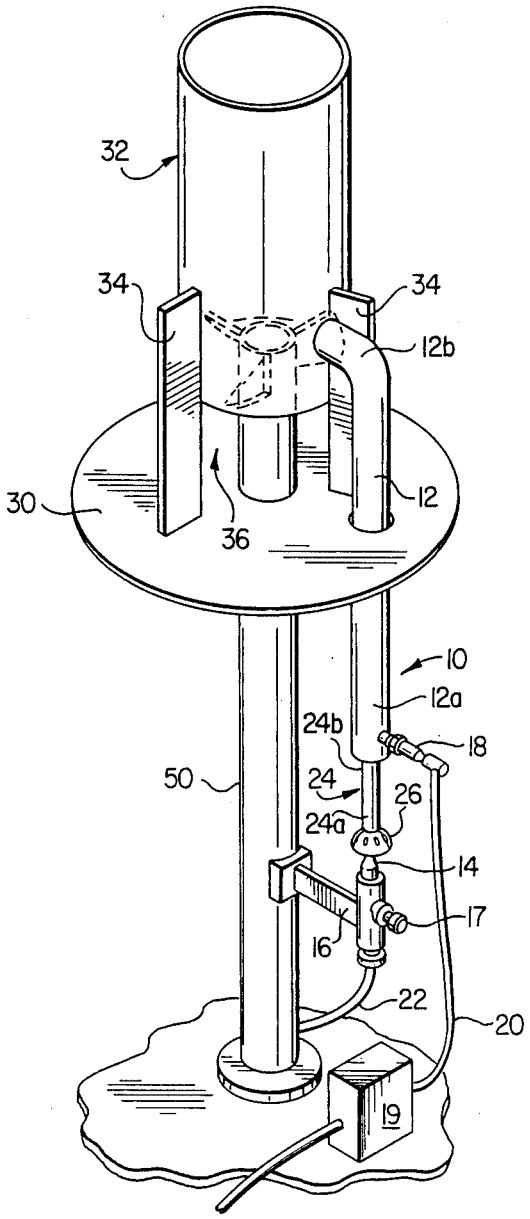
FIG. 1 is a perspective view of the ignitor, baffle plate and bonnet.

The present invention is an ignitor device that overcomes many of the disadvantages found in the prior art. Referring to FIG. 1, an ignitor device 10 embodying the present invention is disclosed. Gas ignitor 10 comprises four primary elements, a burner tube 12, a nozzle 14, an expansion tube 24, and a spark plug 18.

The burner tube 12 is attached to a flare pipe 50 so that the longitudinal axis of the burner tube 12 is parallel to the longitudinal axis of the flare pipe 50. The burner tube's upstream end 12*a* is straight and the downstream end 12*b* is any suitable shape but is preferably bent into a 90° elbow. The combustion of fuel gas occurs in the burner tube.

The expansion tube 24 is a pipe with an upstream end 24*a* and a downstream end 24*b*. The internal diameter increases from the upstream end 24*a* to the downstream end 24*b*. The expansion tube 24 creates a path from the nozzle 14 into the upstream end 24*a* of the burner tube 12.

The nozzle 14 is mounted in a support 16 and said support 16 is typically attached to the flare pipe 50 so that fuel exiting the nozzle 14 enters the open upstream end 24*a* of the expansion tube 24. The nozzle 14 is slidably mounted in the support 16 and the between the nozzle 14 and the upstream end 24*a* of the expansion tube 24 may be easily adjusted by an adjustment screw 17 for a proper air/gas mix.

A conventional coil spark plug 18 projects through the side wall of the burner tube 12 so that the spark plug's electrodes (not shown) are positioned inside the burner tube 12. The spark plug 18 is connected to an external power supply (not shown) by means of an electrical connector 20. A timer device 19 is connected in the circuit between the spark plug 18 and the electrical power supply.

In operation, the nozzle 14 is connected to an external fuel supply (not shown) by means of a fuel line 22. Fuel flows out the nozzle 14 and mixes with air before entering the upstream end 12*a* of burner tube 12. Mixing occurs in a constant-taper expansion tube 24 leading into the upstream end 12*a* of the burner tube 12. A conical windshield 26 extends from the upstream end 24*a* of the expansion tube 24 protecting the spray of fuel from the nozzle 14 from high winds. Air is drawn through holes 28 in the conical windshield 26, and into the expansion tube 24.

The timer device 19 can accept current from the electrical power supply and create an electrical pulse at regularly timed intervals. The pulse is applied to the conventional coil design spark plug 18 producing a spark inside the burner tube 12. The spark ignites the mixture of air and fuel within the burner tube 12 causing a flame to extend out of the downstream end of burner tube 12 and across the top of flare pipe 50. The flame from the burner tube 12 ignites waste gases exiting the flare pipe 50. The electrical pulse to the spark plug 18 is repeated at predetermined intervals, typically every five to thirty seconds, in case it is necessary to reignite the mixture within the burner tube 12.

Once the waste gases from the flare pipe are ignited, a baffle plate 30 is provided to protect both the ignitor device 10 and the flare pipe 50 from the flame licking down the pipe. The baffle plate 30 typically a round steel plate through which both the ignitor 10 and the flare pipe 50 extend. It is normally welded perpendicularly to the ignitor and/or flare pipe.

A bonnet 32 is attached above the baffle plate 30. The longitudinal axis of the bonnet coincides with the longitudinal axis of the flare pipe. The bonnet 32 is a cylinder with an open bottom end 32*a* and an open top end 32*b*. The bonnet 32 has a larger diameter than the flare pipe 50, which extends slightly into the bottom end 32*a* of the bonnet 32.

The bonnet 32 is supported above the baffle plate 30 by pillars 34. These pillars 34 define an air space 36. Air is drawn through this space 36 by the low pressure created by the exhausting combusting waste gases. This air mixes with the waste gases to support combustion. The amount of air drawn into the waste gas for combustion can be controlled by adjusting the height of the pillars 34.

The bonnet 32 is attached to the discharge pipe 50 by angular vanes 38. These vanes 38 create a swirling motion to the combusting waste gases which induces a more stable flame. This swirling motion is created by the angular planes of the vanes 38. Vanes 38a may also be provided within the tip of the flare pipe 50.

Figure 2:
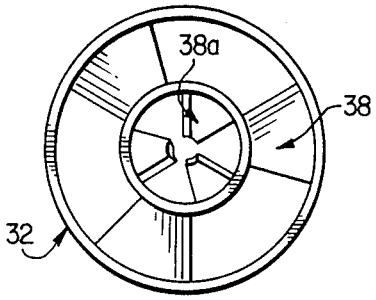
FIG. 2 is a cross-sectional view across the bonnet and flare pipe.

FIG. 2 provides a cross-sectional view along the flare pipe 50 and the bonnet 32. Angular vanes 38 attach the bonnet to the flare pipe. Angular vanes 38 also swirl air drawn into the bonnet through air space 76. Angular vanes 38a can also be located in the end of flare pipe 50 to swirl exiting waste gas.

Figure 3:
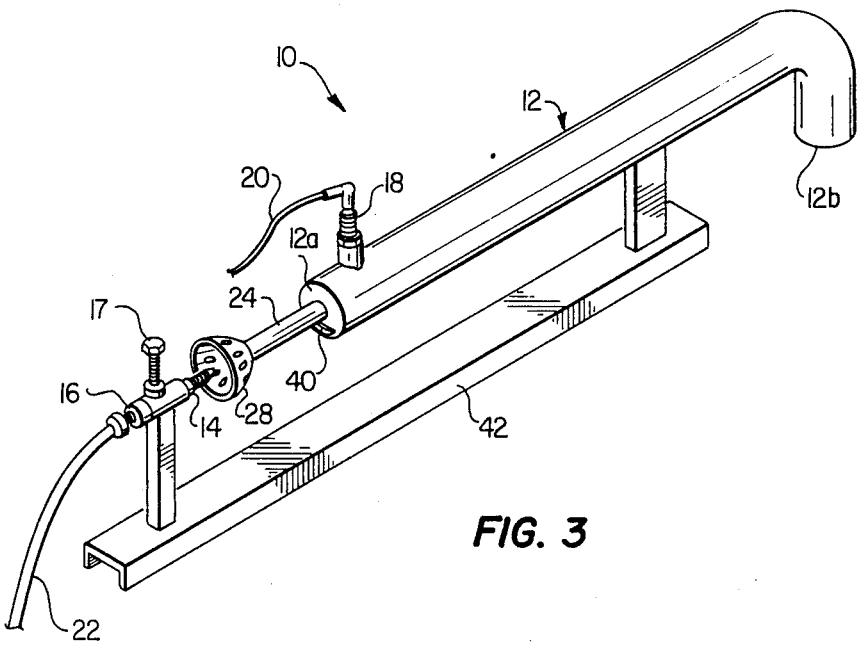
FIG. 3 is a perspective view of the ignitor device showing its drain.

FIG. 3 provides a perspective view of the ignitor 10 from its upstream end. A drainage hole 40 can be seen. This drainage hole 40 provides an exit for fluids which have flowed into the ignitor 10 due to rain, spillover or condensation. The expansion tube 24 also acts as a drain. In this embodiment, the ignitor 10 is mounted on a U-channel steel shaft 42.

Figure 4:
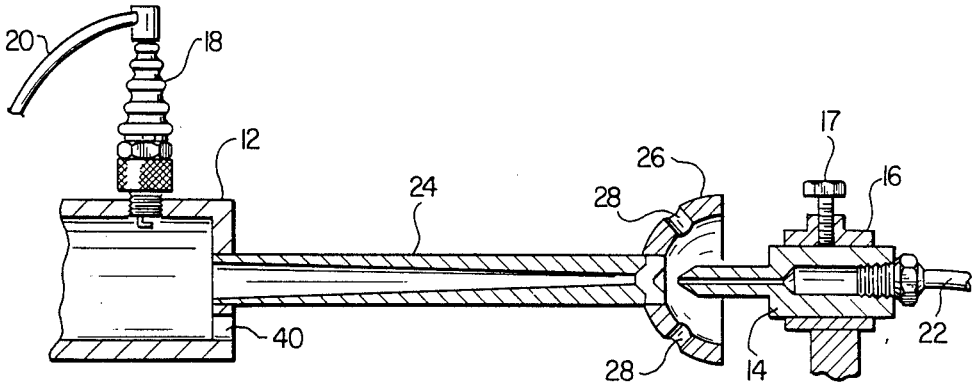
FIG. 4 is a longitudinal cross-sectional view of the ignitor device.

FIG. 4 provides a longitudinal view of the ignitor device 10. Note the constant taper of the expansion tube 24 as it leads from the nozzle 14 to the burner tube 12.

In summary, the present invention provides an ignitor device with a baffle plate and bonnet. In the preferred embodiment, the ignitor is mounted parallel to a flare pipe. An electrical pulse is created at regularly timed intervals by a timer device and is supplied to a conventional spark plug mounted through the side of the burn tube. This pulse creates a spark which ignites the fuel gas being fed to the burn tube from the nozzle and through the expansion tube. The downstream end of the burn tube is bent into a 90° elbow so that flame emitting from the ignitor is typically directed over the exhaust end of the flare pipe, thus igniting waste gases exhausting therefrom. A baffle plate extends radially around both the ignitor and the flare pipe. A bonnet is attached above the baffle plate and around the flare pipe. The ignitor is outside the bonnet except where the downstream end extends through the side of the bonnet. Vanes within the bonnet swirl the flame created by the combusting waste gases. This flame then emits through the top of the cylindrical bonnet.

Although preferred embodiments of the invention have been described in the foregoing Detailed Description and illustrated in the accompanying drawings, it will be understood that the invention is not limited to the embodiments disclosed, but is capable of numerous rearrangements, modifications, and substitutions of parts and elements without departing from the spirit and scope of the invention. Accordingly, the present invention is intended to encompass such rearrangements, modifications, and substitutions of parts and elements as fall within the spirit and scope of appended claims.

What is claimed:

1. An apparatus to ignite combustible gases exhausting from a flare pipe, comprising:

(a) a burner tube mounted to said flare pipe;

(b) a means to produce a spark within the burner tube at regularly timed intervals;

(c) an expansion tube of increasing inner diameter, the downstream end with the larger inner diameter fixedly attached to the upstream end of the burner tube; and (d) an injector nozzle for injection of fuel gas into said expansion tube slidably and removably mounted in line with the upstream end of said expansion tube.

2. The apparatus of claim 1, wherein said burner tube comprises a pipe with a downstream end and an upstream end, said downstream end being open and disposed near the exhaust end of said flare pipe.

3. The apparatus of claim 2, wherein said burner tube further comprises a pipe with a means to drain fluid from the upstream end of said pipe.

4. The apparatus of claim 1, wherein said means to produce a spark within the burner tube comprises a spark plug mounted through the wall of the burner tube such that its electrodes are inside the burner tube near the downstream end of the expansion tube, and a timer device.

5. The apparatus of claim 1, wherein said expansion tube comprises a tube with an upstream end with a small inner diameter end and a downstream end with a larger inner diameter end, and said downstream end extends into the burner tube's upstream end.

6. The apparatus of claim 1, wherein said injector nozzle comprises an orifice whose distance from the downstream end of the expansion tube is adjustable.

7. An apparatus to ignite combustible gases exhausting from a flare pipe comprising:

(a) a burner tube mounted in parallel relationship to said flare pipe;

(b) a means of creating a spark within the burner tube at regularly timed intervals;

(c) an expansion tube of constantly tapering inner diameter, fixedly attached through the downstream end of said burner tube;

(d) a conical shield fixedly extending from the upstream end of said expansion tube;

(e) an injector nozzle slidably mounted in line with the upstream end of said expansion tube;

(f) a baffle plate extending perpendicularly from and rigidly affixed to both the flare pipe and the burner tube; and (g) a bonnet which is rigidly attached above said baffle plate and around said flare pipe.

8. The apparatus of claim 7, wherein said burner tube comprises a metal pipe with an upstream end and a downstream end, said upstream end being bent into an elbow up to 90°, said downstream end having a drainage hole.

9. The apparatus of claim 7, wherein said means to produce a spark within the burner tube comprises a spark plug mounted through the wall of the burner tube such that its electrodes are inside the upstream end of the burner tube.

10. The apparatus of claim 7, wherein said means to produce a spark with the turner tube further comprises a timer device capable of sending an electrical pulse to the spark plug at regularly spaced intervals.

11. The apparatus of claim 7, wherein said expansion tube comprises a pipe of constant outer diameter but whose inner diameter increases from its upstream end to its downstream end, said expansion tube defining a path from the nozzle to the inside of the downstream end of the burner tube.

12. The apparatus of claim 7, wherein said conical shield comprises a conically shaped member, open at both ends.

13. The apparatus of claim 7, wherein said conical shield further comprises a structure with air holes in spaced apart relationship.

14. The apparatus of claim 7, wherein said injector nozzle comprises an orifice designed to atomize any fluid stream passing therethrough.

15. The apparatus of claim 7, wherein said injector nozzle is mounted within a bracket which is rigidly attached to said flare pipe, said bracket extending from the flare pipe far enough to place said nozzle in line with the longitudinal axis of said expansion tube and said burner tube.

16. The apparatus of claim 15, wherein said bracket further comprises a screw positioned to allow the application of variable friction on said mounted nozzle, thus allowing slidable adjustment.

17. The apparatus of claim 7, wherein said baffle plate comprises a high-temperature carbon stainless steel plate.

18. The apparatus of claim 7, wherein said bonnet comprises a cylindrical metal structure open at both ends, with internal vanes.

19. The apparatus of claim 18, wherein said bonnet further comprises a cylinder whose longitudinal axis coincides with that of the flare pipe, said bonnet rigidly held above said baffle plate, said flare pipe extending within said bonnet, and said burner tube's downstream end extending through the wall of the bonnet and over said flare pipe.

20. An apparatus to ignite combustible gases, comprising:

(a) a burner tube;

(b) a means to produce a spark within the burner tube at regularly timed intervals;

(c) an expansion tube of increasing inner diameter, the downstream end with the larger inner diameter fixedly attached to the upstream end of the burner tube; and (d) an injector nozzle for injection of fuel gas into said expansion tube slidably and removably mounted in line with the upstream end of said expansion tube.

21. The apparatus of claim 20, wherein said burner tube comprises a pipe with a downstream end and an upstream end, said downstream being open.

22. The apparatus of claim 21, wherein said burner tube further comprises a pipe with a means to drain fluid from the upstream end of said pipe.

23. The apparatus of claim 20, wherein said means to produce a spark within the burner tube comprises a spark plug mounted through the wall of the burner tube such that its electrodes are inside the burner tube near the downstream end of the expansion tube, and a timer device.

24. The apparatus of claim 20, wherein said expansion tube comprises a tube with an upstream end with a smaller inner diameter end and downstream end with a larger inner diameter end, and said downstream end extends into the burner tube's upstream end.

25. The apparatus of claim 20, wherein said injector nozzle comprises an orifice whose distance from the downstream end of the expansion tube is adjustable.

* * * * *